US011603505B2

(12) United States Patent
Kellens et al.

(10) Patent No.: US 11,603,505 B2
(45) Date of Patent: Mar. 14, 2023

(54) DUAL MITIGATION OF GE DURING THE PHYSICAL REFINING OF EDIBLE OILS AND FATS

(71) Applicant: Desmet Belgium, Zaventem (BE)

(72) Inventors: Marc Kellens, Mechelen-Muizen (BE); Wim De Greyt, Sinaai (BE); Antonios Papastergiadis, Veltem-Beisem (BE)

(73) Assignee: Desmet Belgium, Zaventem (BE)

( * ) Notice: Subject to any disclaimer, the term of this patent is extended or adjusted under 35 U.S.C. 154(b) by 0 days.

(21) Appl. No.: 17/555,537

(22) Filed: Dec. 20, 2021

(65) Prior Publication Data

US 2022/0195329 A1 Jun. 23, 2022

Related U.S. Application Data

(60) Provisional application No. 63/129,968, filed on Dec. 23, 2020.

(51) Int. Cl.

| | |
|---|---|
| ***C11B 3/14*** | (2006.01) |
| ***C11B 3/08*** | (2006.01) |
| ***C11B 3/00*** | (2006.01) |

(52) U.S. Cl.

CPC ..... *C11B 3/14* (2013.01); *C11B 3/001* (2013.01); *C11B 3/08* (2013.01)

(58) Field of Classification Search

CPC ..... C11B 3/001; C11B 3/14

See application file for complete search history.

(56) References Cited

U.S. PATENT DOCUMENTS

2013/0287925 A1* 10/2013 Schols ..... B01D 3/38 426/601

FOREIGN PATENT DOCUMENTS

| | | | | |
|---|---|---|---|---|
| EP | 2548942 A1 * | 1/2013 | ..... | A23D 9/013 |
| EP | 2548942 A1 | 1/2013 | | |
| GB | 812474 A * | 4/1959 | ..... | C11B 3/001 |
| WO | 2011/069028 A1 | 6/2011 | | |
| WO | 2017/214079 A1 | 12/2017 | | |
| WO | WO 2017/214079 * | 12/2017 | ..... | C11B 3/001 |
| WO | 2019/007641 A1 | 1/2019 | | |

OTHER PUBLICATIONS

"Code of Practice for the reduction of 3-monochloropropane-1,2-diol esters (3-MCPDs) and glycidyl esters (GEs) in refined oils and food products made with refined oils", CXC 79-2019, published in 2019, Food and Agriculture Organisation of the United Nation (Codex Alimentarius), 7 pages.

* cited by examiner

*Primary Examiner* — Yate' K Cutliff

(74) *Attorney, Agent, or Firm* — McDonald Hopkins LLC

(57) ABSTRACT

A vegetable oil physical refining process able to mitigate the occurrence of glycidyl esters (GE) including at least a deodorization step followed by a stripping step, wherein, the deodorization step includes contacting said vegetable oil with steam at a pressure above 5 mbara, during at least 10 minutes at a temperature of at least 230° C., and wherein the stripping step includes stripping the oil resulting from the deodorization step at a pressure below 5 mbara and at a temperature not exceeding 280° C. The process does not compromise the heat bleaching and the full removal of unwanted colours, taste and smell from the physically refined edible oil.

15 Claims, 2 Drawing Sheets

DUAL MITIGATION OF GE DURING THE PHYSICAL REFINING OF EDIBLE OILS AND FATS

CROSS REFERENCE TO RELATED APPLICATIONS

This application claims the priority benefit of U.S. Provisional Patent Application No. 63/129,968 filed Dec. 23, 2020, the entirety of which is incorporated by reference herein.

FIELD OF INVENTION

The present invention relates to a process for the physical refining of edible oils and fats able to mitigate the occurrence of glycidyl esters (GE).

BACKGROUND OF THE INVENTION

The physical refining of edible oils and fats is the last step of their purification procedure.

BRIEF DESCRIPTION OF THE INVENTION

According to one aspect of the present invention, the process includes the physical refining of a vegetable oil including a) a deodorization step carried out at a pressure above 5 mbara, at a temperature of at least 230° C. and during at least 10 minutes, and b) a steam-stripping step of the oil resulting from the deodorization step carried out at a pressure below 5 mbara, and at a temperature not exceeding 280° C., characterized in that the FFA concentration of the oil resulting from the deodorization step contains at least 0.5% FFA, and further contains no more than 5 ppm GE.

In another aspect of the above described process for the physical refining of a vegetable oil wherein said deodorization step is carried out at a pressure above 10 mbara.

In another aspect of the above described process for the physical refining of a vegetable oil wherein said deodorization step is carried out at a pressure above 20 mbara.

In another aspect of the above described process for the physical refining of a vegetable oil wherein said deodorization step is carried out at a pressure above 50 mbara.

In another aspect of the above described process for the physical refining of a vegetable oil wherein said deodorization step is carried out at a temperature of at least 245° C.

In another aspect of the above described process for the physical refining of a vegetable oil wherein said deodorization step is carried out at a temperature of at least 260° C.

In another aspect of the above described process for the physical refining of a vegetable oil wherein said steam-stripping step is carried out at a pressure below 3 mbara.

In another aspect of the above described process for the physical refining of a vegetable oil wherein said steam-stripping step is carried out at a pressure below 2 mbara.

In another aspect of the above described process for the physical refining of a vegetable oil wherein said oil resulting from the deodorization step contains at least 1% of FFA.

In another aspect of the above described process for the physical refining of a vegetable oil wherein said oil resulting from the deodorization step contains at least 2% of FFA.

In another aspect of the above described process for the physical refining of a vegetable oil wherein said oil resulting from the deodorization step contains no more than 3 ppm of GE.

In another aspect of the above described process for the physical refining of a vegetable oil wherein said oil resulting from the deodorization step contains no more than 2 ppm of GE.

In another aspect of the above described process for the physical refining of a vegetable oil wherein said oil resulting from the steam-stripping step contains no more than 1 ppm of GE.

In another aspect of the above described process for the physical refining of a vegetable oil wherein said oil resulting from the steam-stripping step contains no more than 0.5 ppm of GE.

In another aspect of the above described process for the physical refining of a vegetable oil wherein the oil arising from said stripping step is cooled at a temperature not exceeding 230° C. in less than 5 minutes.

In another aspect of the above described process for the physical refining of a vegetable oil wherein the oil arising from said stripping step is cooled at temperature not exceeding 230° C. in less than 5 minute and further deodorized in a second deodorization step by contacting said cooled oil with steam at a temperature not exceeding 230° C. and at pressure below 5 mbara for a duration of at least 10 minutes.

In another aspect of the above described process for the physical refining of a vegetable oil wherein the oil arising from said stripping step is cooled at temperature not exceeding 230° C. in less than 5 minute and further deodorized in a second deodorization step by contacting said cooled oil with steam at a temperature not exceeding 230° C. and at pressure below 5 mbara for a duration of at least 10 minutes and the steam exiting the second deodorization step is at least partially recycled in the deodorization step a) and/or the steam-stripping step b).

In another aspect of the above described process for the physical refining of a vegetable oil wherein the vegetable oil intended to be physically refined is washed and/or degummed and/or bleached.

In another aspect of the above described process for the physical refining of a vegetable oil wherein the vegetable oil intended to be physically refined is bleached by contacting it with bleaching earth and said contacting is realised at a reduced pressure comprised between 50 and 250 mbara.

In another aspect of the above described process for the physical refining of a vegetable oil wherein the vegetable oil intended to be physically refined is bleached by contacting it with bleaching earth and said contacting is realised at a reduced pressure comprised between 50 and 250 mbara and the deodorization step a) is realised essentially at the same reduced pressure comprised between 50 and 250 mbara.

In another aspect of the above described process for the physical refining of a vegetable oil wherein FFA is added to the vegetable oil about to be deodorized.

In another aspect of the above described process for the physical refining of a vegetable oil wherein said stripping step is carried out by contacting the oil with the stripping steam in a metallic packed column.

In another aspect of the above described process for the physical refining of a vegetable oil wherein said stripping step is carried out by contacting the oil with the stripping steam in a falling film.

In another aspect of the above described process for the physical refining of a vegetable oil wherein said stripping step is carried out by contacting the oil with the stripping steam in a shallow tray.

In another aspect of the above described process for the physical refining of a vegetable oil wherein the steam exiting the steam-stripping step b) and containing fatty matters stripped from the oil is cooled and at least a part of said fatty matter is condensed to yield a liquid fatty phase that is at least partially added in the vegetable oil intended to be deodorized.

In another aspect of the above described process for the physical refining of a vegetable oil wherein the steam exiting the steam-stripping step b), and containing fatty matters stripped from the oil, is cooled, and at least part of said fatty matter is condensed to yield a liquid fatty phase, said liquid fatty phase being heated at a temperature of at least 200° C.

In another aspect of the above described process for the physical refining of a vegetable oil wherein the steam exiting the steam-stripping step b), and containing fatty matters stripped from the oil, is cooled and at least part of said fatty matter is condensed to yield a liquid fatty phase, said liquid fatty phase being heated at a temperature of at least 200° C., and at least partially added in the vegetable oil intended to be deodorized.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF THE FIGURES

These and other features of the present invention, and their advantages, are illustrated specifically in embodiments of the invention now to be described, by way of example, with reference to the accompanying diagrammatic drawings, in which.

Figure 1:
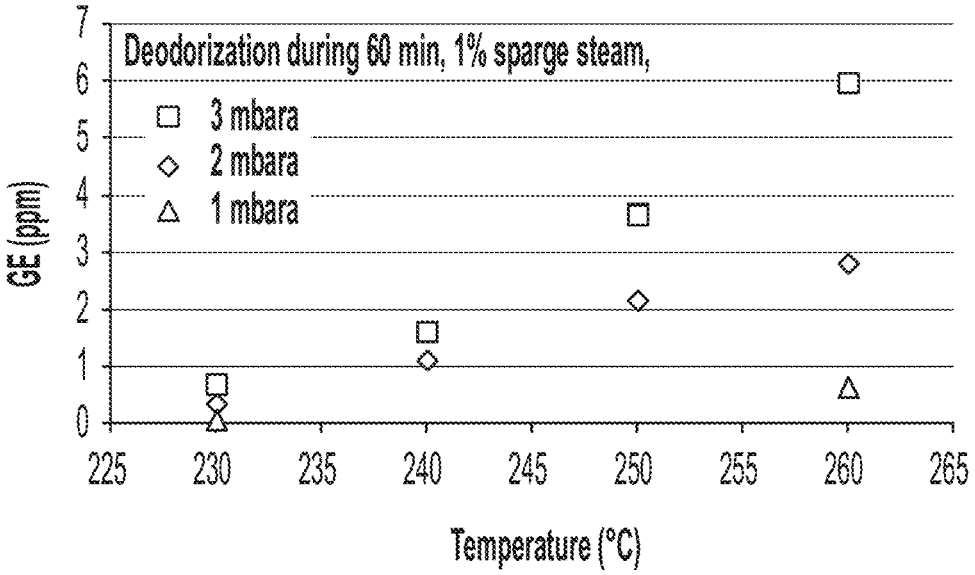
FIG. 1 represents the concentration of GE resulting from the deodorization of palm oil in function of the deodorization temperature and the deodorization pressure.

The drawing(s) and description are to be regarded as illustrative in nature and not as restrictive.

DETAILED DESCRIPTION OF THE INVENTION

Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In at least some instances, the approximating language may correspond to the precision of an instrument for measuring the value. Range limitations may be combined and/or interchanged, and such ranges are identified and include all the sub-ranges stated herein unless context or language indicates otherwise. Other than in the operating examples or where otherwise indicated, all numbers or expressions referring to quantities of ingredients, reaction conditions and the like, used in the specification and the claims, are to be understood as modified in all instances by the term "about".

"Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present.

As used herein, the terms "comprises", "comprising", "includes", "including", "has", "having", or any other variation thereof, are intended to cover a non-exclusive inclusion. For example, a process, method, article or apparatus that comprises a list of elements is not necessarily limited to only those elements, but may include other elements not expressly listed or inherent to such process, method, article, or apparatus.

The singular forms "a", "an", and "the" include plural referents unless the context clearly dictates otherwise.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

Definitions

Physical refining. In the context of the present invention, the terms "physical refining" refer to a process yielding a fully refined oil or fat and including firstly a deodorization step and secondly a steam-stripping step. Optionally a short post-deodorization, preferably under mild conditions, may be realized after the steam-stripping step.

Deodorization. In the context of the present invention, the term "deodorization" is the first step of the physical refining process according to the present invention, where the oil is specifically maintained at high temperature in at least one deodorizing tray in order to remove unpleasant taste, odours, colours and most contaminants of the processed oil. In the present invention, the deodorization step is realised under seemingly unfavourable conditions, i.e. high pressure and high temperature, which lead to a substantial reduction of the removal of FFA present in the processed oil obtained after said deodorization step. Those conditions are the very opposite of the current trend for deodorization making use of the lowest possible pressure (lower than 5 mbara) and low temperature (at about 230° C. or below). In the present invention, typically, the deodorization is realized at much higher pressure than usual, for example 5 to 100 mbara which is about 2 to 50 times higher than conventional deodorization pressure. In the present invention, the deodorization step is realized at about 230° C. to 280° C., preferably at about 250° C. to 270° C. and even more preferably at about 255° C. to about 265° C. This preferred range is a compromise between high temperature giving the best heat bleaching results and lower temperature avoiding excessive removal of the FFA, when combined with high deodorization pressures. According to our invention, the deodorization step is also realised with minimal sparging steam in order to minimize the removal of FFA. Surprisingly, it has been observed that in those seemingly unfavourable deodorization conditions, the GE occurrence is mitigated compared to standard deodorization conditions performed at lower pressure which results in a much more complete removal of FFA. If the processed oil already contains large amount of GE, for example palm oil that has been deodorised by a conventional process where FFA are first stripped and the resulting FFA free oil is deodorised at high temperature and low pressure for example, the deodorization, realised according to the present invention, can even eliminating a substantial fraction of those GE. Thus, the deodorization realized according to the present invention is able to pre-mitigate the occurrence of GE both by mitigating its formation and by destroying a substantial fraction of GE in case the incoming oil already contains GE. Simultaneously, since the deodorisation, according to the present invention, is still realized at high temperature, the deodorisation-function per se of said deodorization (i.e., the removal of odours and off-taste) and the heat bleaching (i.e., the removal of colour) remains fully effective.

High pressure. In the context of the present invention, the terms "high pressure" refer to pressure in the range of 5 mbara to 100 mbara. Thus, a "high pressure" is still below the atmospheric pressure but will be considerably higher than usual deodorization pressure used in current industrial deodorizing practice which usually ranges between about 2 mbara to about 5 mbara in most physical refining installations.

Steam-stripping. In the context of the present invention, the term 'steam-stripping" refers to the second step of the physical refining of the present invention where, typically, about 90% to 99% of FFA, and about 80% to 90% of the GE are removed from the processed oil. This steam-stripping is realized preferably in a stripping column filled with a metallic structured packing (known in the field as "metallic packed column") where the oil is contacted with stripping steam. However, the present invention is not limited to the use of a metallic packed column since the steam-stripping can also be realised on falling film, or in shallow sparging tray. The steam-stripping is preferably realized at low pressure (5 mbara or lower), at high temperature (230° C. or higher) and with sufficient stripping steam (typically at least about 5 kg per ton of processed oil) and with a retention time, in the metallic packed column, of for example about 5 minutes. In those conditions, about 80% to 90% of the GE can be removed.

Post-deodorization. In the context of the present invention, the term "post-deodorization" refers to a second deodorization subsequent to the steam-stripping. The post-deodorization is optional. However, it is sometimes wished or necessary to remove any residual colour, taste or odour, that may exceptionally still remain in the deodorized and steam-stripped oil. This situation is mostly observed for low-grade oils. Typically, the sparging steam used during the post-deodorization can be recycled in the previous stripping and/or deodorization steps because this one is not loaded with much contamination and is substantially free of FFA. Post-deodorization is preferably realized under mild conditions, typically at temperatures that do not exceed 230° C. This post-deodorization is preferably realised by contacting the processed oil with sufficient sparging steam, typically about 5 to about 10 kg/ton of oil or more. Preferably, this sparging steam is recycled, at least partially, in any of the preceding steps of the process according to the present invention. Post-deodorization is only realised if needed and in the milder tolerable conditions, since such post-deodorisation, realized in absence of FFA does not mitigate the formation of the GE as it is the case during the first, high-pressure deodorization step of the process according to the present invention. The post-deodorization is preferably realised at low pressure to enhance the stripping/evaporation of GE. Indeed, since the processed oil does not contain FFA at this stage of the physical refining process according to the present invention, post-deodorization at high-pressure would be disadvantageous.

Oil. In the context of the present invention, the term "oil" encompasses vegetable oils and fats such as for example palm oil, palm kernel oil, coconut oil and their blends. Before undergoing the process according to the present invention, those oils are usually degummed and bleached and thus partially refined. However, oils that have already been physically or chemically refined, or oils that have been modified by fractionation and/or interesterification can also benefit of the process according to the present invention.

Processed oil. In the context of the present invention, the terms "processed oil" refer to any oil being physically refined by the process according to the present invention. The terms "processed oil" also refer to any intermediate state of such oil during the physical refining process according to the present invention. Typically, the processed oils have been previously degummed and bleached, optionally pre-washed in order to remove MCPDs chlorine precursors, but the invention is not limited to oils of this nature and include oils that may have undergone less or more previous purification or modification processes, or oils that have been already physically or chemically refined.

FFA. In the context of this invention, the abbreviation 'FFA' means free fatty acids. The origin of those FFA in the processed oils is often natural, meaning that the FFA present in the oils or fats are the result of the natural hydrolysis of the triglycerides occurring during the extraction and/or storage and/or transportation of said oils or fats. However, optionally, the FFA concentration of the processed oil can be increased by adding FFA from any source.

GE. In the context of this invention, the abbreviation "GE" means glycidyl esters. GE are process contaminant formed during the conventional physical refining, principally during the deodorization step, particularly if this one is realised at high temperature, such as 260° C. for example. If this step is realized in mild conditions i.e., relatively long deodorization time at moderate temperature, (about 230° C. or lower) and low pressure, the GE formation can be moderately mitigated. However, a sufficiently intense deodorization is necessary to meet organoleptic and colour specifications. Consequently, milder deodorization conditions can moderately mitigate the amount of GE formed compared to deodorization realized at higher conventional temperature but will not deliver a physically refined oil with low colour with level of GE below 1 ppm. Furthermore, if GE are already present in the processed oil, those mild deodorization conditions are of no avail. This situation is in fact relatively frequent in case of the physical refining or deodorization of an old oil that has been already physically refined previously. It must be noted that even if the GE present in such old physically refined oil can be destroyed by a bleaching realised in acid conditions, a subsequent deodorization remains mandatory to remove the typical bleaching off-taste and hence, the process according to the present invention remain advantageous. Finally, milder deodorization condition induces very long processing duration, sometimes exceeding several times the expected duration generally applied in the industry, and still are unable to deliver consistently an oil meeting the highest organoleptic and colour standards.

Figure 2:
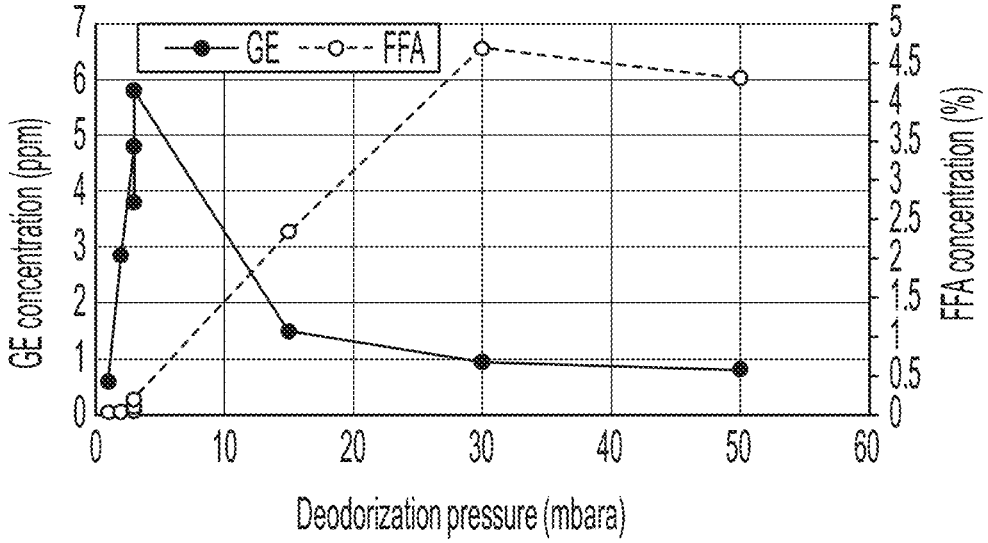
FIG. 2 represents the concentration of GE and FFA present in deodorised palm oil in function of the deodorization pressure.

The invention will be disclosed in detail with the help of FIG. 1 and FIG. 2 and with the results obtained in various deodorization and steam-stripping experiments realised for various process conditions.

In particular, the present invention provides a novel physical refining process able to mitigate GE to very low level, without compromising the heat bleaching and the full removal of unwanted colours, taste and smell from the physically refined edible oil. Furthermore, the present invention is also economical and does not require large investments, long processing time or the use of complex new piece(s) of equipment, chemicals or adsorbents, and may reduce the generation of waste streams compared to current technologies.

Physically refined edible oils or fats are expected to be safe for human consumption, and thus, must meet all the trade and legal specifications including organoleptic properties (smell and taste), colour, oxidative stability, low level of free fatty acid, and a low level of contaminants including pesticides, polycyclic hydrocarbons, dioxins, chlorinated biphenyls (PCB), trans-fatty acids (TFA), 3-monochloropropane-1,2-diol esters (3-MCPDE) and glycidyl esters (GE). In particular, the contamination by 3-MCPDE and GE, has been the object of several scientific studies and regulations during the recent years, predominantly in Europe, where the acceptable level of GE in edible oils and fats has been drastically lowered. In this region, currently, GE concentration in edible oils and fats must be below 1 ppm and even below 0.5 ppm for oils and fats destined to infant food products. It is also expected that in the future, even stricter GE limits will be adopted, not only in Europe but, in fact, worldwide.

It has been observed that palm oil is particularly sensitive to GE formation during the physical refining process, mainly during the deodorization step. Furthermore, this situation is even worsened by some modification processes applied to refined palm oil such as for example the dry or solvent fractionation. Indeed, after physical refining, most palm oils are frequently fractionated into a variety of olein and stearin products, to extend their use range in the food industry. However, it must be remembered, that since fractionation concentrates the contaminants in the olein fraction(s), the refined oil should contain an even lower concentration of GE than the one admitted legally in order to ensure that the olein fraction(s) remain low enough in GE. Consequently, edible oil refiners, in particular palm oil refiners, need a physical refining process able to mitigate GE to extremely low level. Furthermore, since palm oil is a commodity product, such physical refining process must remain very economical.

As a matter of fact, it has been shown that 3-MCPDE and GE are process contaminants: the conventional physical refining of edible oils and fats is generating those contaminants from precursors already present in un-deodorized oils or fats. Precursors of 3-MCPDE are chlorine and/or chlorinated substances present, at trace level, in the crude oil. Precursors of GE are partial glycerides meaning that, in general, the higher the concentration of FFA in a crude oil, the higher will be the concentration of partial glycerides and the higher will be the risk and extend of the GE formation during the physical refining. This explains why palm oil is particularly concerned with the issue of GE contamination since this tropical oil naturally contains a fairly large amount of FFA ranging usually from about 1 to 3% for good quality crude palm oil to about 4-6% for most common quality crude palm oil. This high FFA content gives an average diglyceride content of 6-8% which makes palm oil particularly sensitive for GE formation during high temperature deodorization.

Thus, the physical refining of edible oil, in particular palm oil, at high temperature, even under deep vacuum, leads to the formation of 3-MCPDE and GE. The formation of 3-MCPDE starts to occur when palm oil is heated at temperatures as low as about 140° C. and the formation of GE starts to occur at temperature higher than about 230° C. However, conducting the physical refining at temperatures below 230° C. or even more so, below 140° C. is hardly conductive to properly deodorized oil. Those low temperatures, even maintained for considerable period of time, will not guarantee proper heat bleaching and deodorization and thus are unable of steadily delivering oil with acceptable colour, taste, odour and stability.

However, the reduction of 3-MCPDE can be satisfactory realized by the removal of chlorine precursors before its deodorization, by washing the crude oil with water, preferably acidified water, even more preferably alkalinised water, and/or by bleaching it with natural or neutral (not acid) bleaching earths. Several washings and/or bleaching can be done successively. Chemical neutralization is also an efficient method to remove chlorine precursors but has the disadvantage, mainly in the case of palm oil, to cause large oil losses in the form of soap stocks containing a high amount of entrained oil. Furthermore, those soap stock must be treated with strong mineral acids to recover an oil stream which is commonly called 'acid oil'. Even if some embodiments of the present invention may alleviate the 3-MCPDE issue, it is believed that the removal of the chlorine precursors prior to the physical refining is the most efficient and safest solution to the 3-MCPDE issue. Unfortunately, this approach is not satisfactory in the case of GE mitigation. Indeed, the precursors of GE are partial glycerides and are inherently valuable constituents of edible oil. Their removal is not desired since it would lead to considerable loss of neutral oil and would decrease the refined oil yield with several percent. Furthermore, the specific removal of partial glycerides is technically difficult. Therefore, efforts so far have focused on physical refining conditions able to mitigate the occurrence of GE to acceptable level, and/or on their removal after the physical refining per se.

It is known that physical refining at low temperature, usually at temperatures of about 230° C. or lower, mitigates the formation of GE compared to a physical refining realised in standard condition i.e. at higher temperature, at for example about 260° C. It is also known that physical refining under deep vacuum is preferred to enhance the stripping of any volatile compounds, including thus the GE. As a matter of fact, such mild deodorization conditions are recommended as best practices by the Food and Agriculture Organisation of the United Nation (Codex Alimentarius, "Code of Practice for the reduction of 3-monochloropropane-1,2-diol esters (3-MCPDs) and glycidyl esters (GEs) in refined oils and food products made with refined oils", CXC 79-2019, published in 2019). However, the quantity of GE formed during such mild physical refining still often exceed the most recent stricter regulation related to GE contamination level in edible oil. Furthermore, physical refining at moderate temperatures will not provide the full heat bleaching and deodorization necessary to obtain a fully physically refined oil having proper colour, flavour, odour, and stability. The concept of mild physical refining is nevertheless effectively applied when the concentration limits of GE in refined oil is less stringent.

Consequently, several physical refining processes able to mitigate GE have been proposed. The ones of interest for the present invention are reviewed below.

According to EP2548942A, physical refining at low temperatures can be associated to the use of acids such as citric acid or oxalic acid. However, the use of acids such as citric acid or oxalic acid in rather large concentrations adds complexity and requires the removal of the acids after the deodorization. Furthermore, the use of such acids, at an elevated deodorization temperature during an extended period of time, may lead to unexpected side reactions having potentially unknown damageable effects. Indeed, even if acids such as citric acid or oxalic acid are food-grade chemicals and are known as reactants in the edible oil field, they are used at rather low temperature (typically 90° C.) and as aqueous solution contacted with edible oil during a short time. For those reasons, to our knowledge, the process described in EP2548942A, despite its merits, is not an industrial success so far.

WO2011/069028A1 describes the removal of GE and/or 3-MCDPE with adsorbents such as bleaching earth and/or silica for example. Those methods are efficient but have the disadvantage of requiring costly chemicals and create a substantial solid waste stream that must be disposed of. Furthermore, the oil treated with an adsorbent has a typical unpleasant off-taste and odour (particularly when bleaching earth is used) and must be deodorized once more, which will increase again the GE concentration of the final refined oil.

WO2019/007641A1 discloses a process for reducing the amount of 3- and 2-monochloropropanediol (MCPD), 3- and 2-monochloropropanediol-fatty acid esters and glycidyl esters (GE) in a refined or modified edible oil by hydrolysis in the presence of an acid catalyst, characterized in that the refined or modified edible oil is brought in contact with a fixed bed of porous bodies larger than 1 mm comprising an acid catalyst comprising at least one of silica-alumina, alumina and gamma alumina. This document reports very significant reduction of GE. However, it is also reported that the treated oil needs to be deodorized again, after having been in contact with the solid acid catalyst. Such post-deodorization, unless realized in mild conditions, will again generate problematic GE and increase the needed investment and the running cost. Furthermore, the edible oils and fats industry usually prefer to use economical and time-proven technology. Indeed, fixed bed of solid acid catalyst is currently not applied during edible oil refining and will inevitability require substantial additional investments.

Results published in WO2017/214079 show that GE can also be removed by steam-stripping realized in a packed column at high temperature and under high vacuum. As a matter of fact, the volatility of GE is comparable to the volatility of the monoacylglycerides and hence GE can be stripped. This GE mitigation method appears to be very promising because no chemicals, no absorbents and no new (unknown) equipment are needed. However, this process has still the disadvantage to generate a distillate that is enriched in GE which also contains valuable components such as monoacyglycerides, tocopherol for example, because their volatilities are similar to the ones of GE. Furthermore, the higher is the GE levels that need to be removed, the higher the stripping steam consumption and the higher the removal of valuable volatile components such as partial glycerides and tocopherols.

Furthermore, a closer examination of the results published in WO2017/214079 shows that even if the removal efficiency of GE by steam-stripping can be improved by using higher stripping temperature and larger stripping steam supply, it remains difficult to reduce GE to extremely low level if the incoming oil contains elevated concentration of GE. Indeed, results published in WO2017/214079 shows that when the concentration of GE of the incoming oil is very high, for example 25.9 ppm, despite the observed removal rate of 89%, 2.7 ppm of GE were still present in the final oil after the post-stripping. Such high GE concentration does not meet the current standard. Thus, even if it is correct that, generally, the steam-stripping efficiency can be improved by using higher stripping temperature, lower pressure and larger stripping steam supply, one must remember that the temperature of the oil, even during a short steam-stripping should preferably be maintained below 280° C. in order to limit thermal degradation, and that the amount of steam used is limited for economic and technical reasons. Generating very low pressure is costly and, in practice, pressures much lower than 1.5 mbara (millibar absolute) are difficult to reach in large industrial facilities. For those reasons, it is safe to assume that the removal of GE from an oil with a realistically optimised steam-stripping will not exceed about 90%.

Therefore, considering a physical refining process wherein the deodorization step is realised before the steam-stripping step, and assuming a reduction of 90% in GE during the steam-stripping step, obtaining a physically refined oil having a concentration in GE of 0.5 ppm implies that the maximal GE concentration of the incoming oil undergoing the steam-stripping should not exceed 5 ppm. Conversely, if the GE concentration could be limited to 2 ppm during the deodorization step preceding a steam-stripping step—which is able to remove 90% of said GE—, then a fully physically refined oil having a GE concentration of 0.2 ppm could be obtained. Therefore, the pre-mitigation of GE before the steam-stripping, hence during the deodorisation, is needed. Specifically, the GE concentration in the oil obtained after the deodorization step should preferably not exceed 5 ppm, even more preferably 2 ppm.

Therefore, despite the respective merits of the prior art, there is a need in the field for an improved physical refining process of edible oils and fats wherein the deodorization is realized at high temperature for efficient heat bleaching and deodorization function per se, while said deodorization is furthermore able to pre-mitigate the GE occurrence, preferably to a concentration lower than 5 ppm, even more preferably to a concentration lower than 2 ppm, and that thus does not necessitate the removal of a large quantity of GE from the deodorized oil during the steam-stripping step and that does not require the use of chemicals and/or adsorbents, and that does not necessitate supplementary piece of equipment that is unknown in the edible oils and fats industry.

There is a need for a physical refining process of edible oils and fats able to mitigate the GE at an acceptable cost for the refiner. Both investment cost and running cost should be minimized and preferably lower than alternative GE mitigation technologies.

There is a need for a physical refining process of edible oils and fats able to mitigate the GE that can be implemented in existing installations without excessive investments.

There is a need for a physical refining process of edible oils and fats able to mitigate GE while still delivering fully deodorized oils or fats meeting the required standard quality parameters such as bland odour and taste, excellent stability, and light colour.

There is a need for a physical refining process of edible oils and fats able to mitigate GE without generating problematic waste streams, or at least reducing waste stream compared to alternative GE reduction technologies.

An Object of the Process

An object of the present process is to provide for the physical refining of edible oil yielding fully refined and deodorized oil having low GE contamination, while simultaneously, avoiding the use of chemicals or adsorbent and avoiding or at least reducing the generation of waste streams. Furthermore, the inventive process should not require major investments or imply prohibitive running cost and should be implementable in typical existing physical refining facilities. The inventive process should not contact the oil with chemicals, absorbent, or solid catalysts.

Advantages of the Process

The present process advantageously provides for the physical refining of edible oil yielding a fully refined and deodorized oil having low GE contamination. Simultaneously said process does not require the use of chemicals or adsorbent and reduce the generation of waste streams compared to existing processes. Furthermore, the inventive process does not require major investments or imply prohibitive running cost and is implementable in typical existing physical refining facilities. The inventive process does not contact the oil with chemicals, absorbents, or solid catalysts. Further advantages of the present invention will become apparent in the detailed description.

When a degummed and bleached oil containing initially no detectable GE is deodorized, the net amount of GE measured after the deodorization step is the result of GE that are formed during said deodorization (and mostly dependent on the temperature and time) minus the GE that are possibly stripped and/or evaporated during the same deodorization (and mostly dependent on the pressure, the temperature, and, to a lower extend, to the amount of sparging steam used). In practice, this means that when an oil is submitted to various deodorization conditions (pressure, duration, temperature, and amount of stripping medium), variable amounts of GE will be present in the resulting deodorised oil. Thus, it has firstly been investigated if particular deodorization conditions could lead to an oil containing low amount of GE while still meeting all the standard quality parameters of a physically refined oil. Therefore, an average quality degummed and bleached palm oil, containing 5% of FFA and no detectable GE has been deodorised for 60 minutes, at 3 mbara, 2 mbara and 1 mbara and at temperatures ranging from 230° C. to 260° C. Rather high amount of sparging steam was used (1%). As those experiments aimed at determining the influence of those parameters specifically during the deodorization step, no subsequent steam-stripping step has been applied. The resulting net GE content has been measured for each deodorization condition. FIG. 1 summarizes this investigation.

In FIG. 1, the evolution of the net GE formation during various deodorization conditions is shown. The results clearly indicate that the net GE content in the deodorized oil is lower when the oil is deodorized at lower pressure and/or lower temperature. For example, at a deodorization temperature of 260° C., the net formation of GE is 6 ppm when the deodorization takes place at 3 mbara. This net formation of GE is only about 2 ppm if the deodorization takes place at 2 mbara and can even be as low as about 0.5 ppm if the deodorization takes place at 1 mbara. A similar impact can be is observed for a given deodorization pressure when the deodorization temperature is decreased. For example, for a deodorization at a pressure of 3 mbara, the net formation of GE is 6 ppm at 260° C., 3.8 ppm at 250° C., 1.6 ppm at 240° C. and 0.8 ppm at 230° C. Realising the deodorization at extremely low pressure and low temperature even deliver an oil containing less than 0.5 ppm of GE. Thus, results summarized in FIG. 1 clearly confirm that the lower the deodorization pressure, and the lower the deodorization temperature, the lower will be the GE present in the deodorised oil. Indeed, this corresponds to the conditions where the formation of GE is mitigated due to the low temperature combined to an efficient removal of GE due to the very low pressure. As a matter of fact, currently, refiners rely on such conclusions to optimize the deodorization conditions and minimize the GE present in the final deodorized oil. However, it must be pointed out that process conditions presented in FIG. 1, which have been applied to lab-scale deodorizer cannot always be implemented on industrial installations. Indeed, refiners are more likely to refine, occasionally, palm oil containing more partial glycerides leading to higher concentration of GE formed during the deodorisation. Furthermore, for a significant fraction of refining facilities, it is either very costly or technically not possible to reach very low deodorization pressure such as 3 mbar or 2 mbar or even more so, 1 mbar. Finally, deodorization at temperature such as 230° C. cannot systematically deliver an oil meeting all the colour and organoleptic expectations, and again this will be highly dependent on the quality of the incoming oil to be deodorized. As a matter of fact, it was observed that the colour and the organoleptic properties of the oils deodorized at lower temperature and presented in FIG. 1 did not meet the industrial quality standards. For those reasons, investigations were pursued with the goal to obtain a robust mitigation of GE combined with a full deodorization at high temperature delivering oil of proper colour and organoleptic properties.

Accordingly, in order to determine how much GE is actually formed during the deodorisation (when no GE stripping is taking place), a standard quality degummed and bleached palm oil (containing 4.85% of FFA and no GE) has been deodorized at very high pressure (50 mbara) and high temperature (260° C.) with low amount of sparging steam (0.2%). These conditions were selected to have no or minimal GE stripping and/or evaporation and allow thus to assess accurately the amount of GE formed at such deodorization temperature. Indeed, it is assumed that no stripping and/or vaporisation of GE will take place at 50 mbara since GE have a rather low volatility comparable to that of monoacylglycerols. For comparative purposes, the same bleached palm oil has been deodorized at low pressure (3 mbara), still at 260° C., with more sparging steam (0.5% and 1.0%) and furthermore, each deodorized oil has been further steam stripped at very low pressure (1.5 mbara). It must be pointed out that all the experiments have been done with a lab deodorizer and that the steam-stripping step has been realised in a shallow tray deodorizer and not with a metallic packed column. For this reason, the efficiency of the steam-stripping to strip GE is inferior to the 80% to 90% that is expected with an optimized steam-stripping performed with a metallic packed column. For each sample, the concentrations of FFA, GE, MCPDE, and a colour measurement have been realized. Results are summarized in Table 1.

TABLE 1

Concentrations of FFA, GE, MCPDE, and colour quantification of common degummed and bleached palm oil in function of various conditions of deodorization and additional steam-stripping.

| Bleached and degummed | Test 1: high pressure deodorization and steam-stripping | | Test 2: low pressure deodorization (0.5% SS) and steam-stripping | | Test 3: low pressure deodorization (1.0% SS) and steam-stripping | |
|---|---|---|---|---|---|---|
| palm oil with 4.85% FFA and no detectable GE | Deodorization 260° C., 60 min, 50 mbara and 0.2% SS | Steam-stripping 260° C., 10 min, 1.5 mbara and 0.5% SS | Deodorization 260° C., 60 min, 3 mbara and 0.5% SS | Steam-stripping 260° C., 10 min, 1.5 mbara and 0.5% SS | Deodorization 260° C., 60 min, 3 mbara and 1.0% SS | Steam-stripping 260° C., 10 min, 1.5 mbara and 0.5% SS |
| FFA (%) | 4.26 | 0.05 | 0.05 | 0.03 | 0.04 | 0.03 |
| FFA removal (%) | 12.2 | 99.0 | 99.0 | 99.4 | 99.2 | 99.4 |
| GE (ppm) | 0.81 | 0.55 | 5.61 | 1.15 | 3.48 | 0.89 |
| 3-MCPDE (ppm) | 2.68 | 2.25 | 2.21 | 1.97 | 2.08 | 1.89 |
| 2-MCPDE (ppm) | 1.32 | 1.10 | 1.06 | 0.97 | 1.01 | 0.94 |
| MCPDs (ppm) | 4.00 | 3.35 | 3.27 | 2.94 | 3.09 | 2.83 |
| Colour (Lovibond) | 5.2R | 3.5R | 3.5R | 3.4R | 3.4R | 3.4R |

SS: Sparging Steam (in the deodorisation step)/Stripping Steam (in the steam-stripping step)

As shown in Table 1 (Test 1), and very surprisingly, only 0.81 ppm of GE was measured in the deodorised oil after a deodorization at 50 mbara at 260° C. for 60 min using 0.2% of sparge steam. This result was totally unexpected, knowing that already 6 ppm of GE was measured, as seen on FIG. 1, for a deodorization realised at 3 mbara at the same temperature and with even higher amount of sparging steam, which is favourable to the stripping of GE. As a matter of fact, the FFA concentration is hardly reduced during a deodorization realised at such high pressure. Indeed, the measured FFA concentration after one hour of deodorization realised at 260° C. at 50 mbara remains at 4.26% (from 4.85% in the incoming oil), corresponding to a removal of 12.2% only. Therefore, we can infer that since a very limited percentage of FFA removal (either by vaporisation and or/stripping) occurred in those conditions, most certainly, no or at least very limited GE removal (either by vaporisation and/or stripping) did occur since GE volatility is considerably lower than the one of FFA. Consequently, what has been discovered is an unexpected method to mitigate the formation of GE during a deodorization even if said deodorization is realised at high temperature such as 260° C. Of course, since the FFA concentration is hardly reduced during such high-pressure deodorization step, the deodorised oil must be steam stripped at low pressure with sufficient quantity of stripping steam to reduce the FFA concentration to acceptable level and to further reduce the GE content. Thus, the efficacy of the steam-stripping realised after the deodorization is confirmed. Additionally, results shown in table 1 confirm that, a steam-stripping following the deodorization can slightly reduce the MCPDE concentration. However, this reduction is more modest than the GE reduction which is expected since it is known that only the 3-MCPD mono esters can be stripped. These account for approximatively 15% of the total 3-MCPDE content. The other 3-MCPDE are di-esters and are not volatile. Furthermore, since the deodorization is realised at high temperature, the heat bleaching is sufficient and fully refined oil with an acceptable colour and a low GE can be obtained after the mandatory steam-stripping step (Table 1, Test 1). In comparison, if the deodorization is realised at low pressure, the GE content of the oil is higher, even after a steam-stripping step.

Therefore, it has been surprisingly found that a physical refining of a vegetable oil, such as palm oil, including firstly a deodorization step realised at high pressure and high temperature and in presence of a substantial concentration of FFA, followed by a steam-stripping leads to a fully physically refined oil having a substantially lower GE concentration compared to a physical refining including a deodorization step realised under conventional conditions, i.e., at low pressure (such as 3 mbara or lower) for which the largest fraction of the FFA are removed. Indeed, Table 1 shows that a deodorization realised at lower pressure (3 mbara, Test 2 and Test 3) results in higher concentration of GE as compared to the deodorization realised at 50 mbara (Test 1). Higher amount of sparging steam during a deodorization realised at low pressure is also able to reduce the net concentration of GE in the deodorised oil, but the effect on the GE reduction is not as effective than the one surprisingly triggered by deodorizing the oil at high pressure in presence of FFA. Indeed, deodorization at low pressure and with 0.5% of sparging steam (Test 2) results in a deodorised oil containing 5.61 ppm of GE whereas a deodorization realised in the same condition but with 1.0% of sparging steam (Test 3) results in a deodorised oil containing 3.48 ppm of GE. But deodorising at high pressure (Test1) results in a deodorised oil containing only 0.81 ppm of GE. It must be noted that the steam-stripping step was realised in a shallow tray and is less efficient than a steam-stripping realised in a packed column. However, nonetheless, even so, results shown in Table 1 indicate that a steam-stripping step realised after a deodorization step is able to further reduce the concentration of GE and the one of FFA.

Those surprising results have been further confirmed by additional experiments realised on a different batch of degummed and bleaching palm oil of similar standard quality. This batch has a FFA concentration of 5.41% and no detectable GE. Several deodorization trials have been realised at intermediate pressure ranging from 3 mbara to 30 mbara. No steam-stripping step have been realised after those deodorizations since the outcome of this step is known. Colour results are not reported but were similar to the ones observed previously. Results are shown in Table 2 and clearly confirm the surprising observation that a deodorization conducted at high pressure in presence of FFA is able to mitigate GE. Indeed, for this particular batch of palm oil, a deodorization realised at 3 mbara results in a net formation of 4.03 ppm of GE while the FFA concentration is reduced from 5.41% to 0.25%. A deodorization realised at 15 mbara results in a net formation of only 1.5 ppm of GE while the FFA concentration is reduced from 5.41% to 2.34%. A deodorization realised at 30 mbara results in the net formation of even less GE (0.95%) while the FFA concentration is moderately reduced from 5.41% to 4.68%. As previously observed, the MCPDE concentration is not clearly affected by a deodorization realised at high pressure.

TABLE 2

Concentrations of FFA, GE, MCPDs, degummed and bleached palm oil in function of the deodorization pressure.

| Bleached and degummed palm oil with 5.41% FFA and no detectable GE | Test 4: Low pressure deodorization and low SS Deodorization at 3 mbara, 0.2% SS 260° C., 60 minutes | Test 5: High pressure deodorization and low SS Deodorization at 15 mbara, 0.2% SS 260° C., 60 minutes | Test 6: High pressure deodorization and low SS Deodorization at 30 mbara ,0.2% SS 260° C., 60 minutes |
|---|---|---|---|
| FFA (%) | 0.25 | 2.34 | 4.68 |
| FFA Removal (%) | 95.4 | 56.8 | 13.5 |
| GE (ppm) | 4.03 | 1.5 | 0.95 |
| 2-MCPD | 1.72 | 1.63 | 1.80 |
| 3-MCPD | 3.53 | 3.34 | 3.50 |
| MCPDs | 5.25 | 4.97 | 5.30 |

SS: Sparging Steam

The aggregation of the results presented in FIG. 1, Table 1 and Table 2 leads to FIG. 2 which reports the GE and FFA concentrations for oils deodorized at a temperature of 260° C. in function of the deodorization pressure.

FIG. 2 clearly shows that in the low deodorization pressure range, the net GE concentration—which is the result of the GE formation minus its stripping and/or evaporation-decreases sharply when the deodorization pressure decreases. As a matter of fact, extrapolation to a deodorization pressure of 0.0 mbara even indicates that no GE should be found in an oil deodorised in those hypothetical conditions which is logical since at such low pressure the GE vaporisation should be complete. But surprisingly, the GE concentration curve shows a maximum corresponding to a pressure of about 5 mbara and then decreases steeply as well to rapidly starting to level off already at about 15 mbara. Conjointly, the FFA concentration curve indicates that at low deodorization pressure (1 to 3 mbara), the removal of FFA is nearly complete, but when this deodorization pressure increases, much less complete removal of FFA is observed. As a matter of fact, a plateau appears when the deodorization pressure reaches about 30 mbara.

Thus, FIG. 2 shows that when the deodorization pressure becomes superior to about 5 mbara, an unexpected mitigation of GE starts to take place and the inflection point corresponds to a FFA concentration of about 0.5%. At higher deodorization pressure, since both the GE and the FFA curves are levelling off, it is expected that much higher deodorization pressure will not be particularly beneficial for further GE mitigation. Thus, extrapolating the curve shown in FIG. 2, very high deodorization pressures, for example higher than 100 mbara do not seem to be particularly more advantageous than a deodorization performed at 50 mbara. Therefore, the process according to the present invention advantageously include a deodorization step realised at the pressure preferably higher than about 5 mbara but preferably lower than about 100 mbara.

Even if the FIG. 2 combines results obtained for several batches of palm oil, and for several sparging steam amounts (0.2%, 0.5% and 1.0%) this aggregation is valid because, on one hand, the starting FFA concentrations of those batches are relatively similar and those variations correspond to the typical FFA concentration variation found in average quality palm oil, and on the second hand, it has been shown that even if the amount of sparging steam has an effect on the GE concentration, this one remains modest. As a matter of fact, this explain why some variation in the GE concentration was observed when the deodorization is performed at 3 mbara. However, despite those small fluctuations, it is clearly shown that a low deodorization pressure, the GE concentration during said deodorization decrease sharply when the deodorization pressure further decreases and as matter of fact this trend is very robust.

Those surprising results have been further confirmed by additional experiments for which the steam-stripping step is realized with a lab-scale packed stripping column.

In test 7, another average quality crude palm oil is first conventionally degummed and bleached. This degummed and bleached oil contains 5% FFA and no detectable GE which is typical for the usual starting palm oil that is about to be deodorized in the refining industry. In test 7, the deodorization step is realized in conventional conditions of temperatures (260° C.), pressure (3 mbar) and sparging steam (0.5%). Those conditions result in 5.6 ppm GE and in the removal of about 90-95% of the FFA. A subsequent stripping, at 260° C. at 1.5 mbara measured at the top of the column and with 0.5% of stripping steam, a retention time in the packed column of about 6 to 8 minutes and a rapid cooling of the stripped oil to 220° C. manages to reduce the amount of GE from 5.6 ppm to 1.2 ppm (reduction of 79%) and further reduce the concentration of FFA to 0.04%. The steam-stripping step of test 7, is slightly less performant than the steam-stripping disclosed in WO2017/214079 because our experimentations has been realised with laboratory equipment and that no optimization has been realized. Nevertheless, those conditions remove nearly 80% of the GE that were formed during the deodorized step. It is believed, that during the stripping step at high temperature, some GE are still formed but, since those GE are stripped at a much higher rate, a net decrease of GE is observed in the steam stripped oil.

In test 8 the same degummed and bleached oil is deodorised at high pressure. This test confirms again, that if the deodorization step is realised at the same temperature (260° C.) but at high pressure (50 mbar) and using very low amount of sparging steam (0.05%), considerably less GE is formed during the deodorization step: 0.8 ppm. Deodorization is such conditions remove only about 10% of the FFA (4.5% of FFA remained after the deodorization step). Subsequent stripping realised in the same condition than test 7 manages to further reduce the amount of GE to 0.5 ppm corresponding to a reduction of 40%. Thus, in that case, the removal of GE during the steam-stripping step is less efficient but since the starting GE concentration is much lower (in fact 7 times lower) than in test 7, it could be that a given quantities of stripping steam will have more difficulties to reach and remove the already mitigated GE. This trend was already visible in WO2017/214079. Another reason why we see here a lower GE reduction during the steam-stripping step could be the higher relative contribution of the GE formed during said stripping. However, the exact contribution of those two possible causes is not fully known currently. Nevertheless, what is essential and totally unexpected is the confirmation that the GE final concentration of the physically refined oil is 0.5 ppm for test 8 compared to 1.2 ppm for the reference test 7. This is even more unexpected for the reason that the conditions of test 8 are in fact more economical than the ones of the reference test 7 since less sparging steam has been used during the deodorization step of test 8. Additionally, less energy has been used to create the vacuum during the deodorization step of test 8.

Further experiments have been realised to determine if the presence of a substantial concentration of FFA is necessary during a deodorization at high pressure to mitigate the GE during said deodorisation. Tests 9 and 10 demonstrate that indeed the presence of FFA during the deodorization is necessary to mitigate the formation of GE during said step In test 9, the conventionally physically refined oil obtained in test 7 (and containing 5.6 ppm of GE) is deodorized again at high pressure for conditions similar to the one of test 8. For those deodorization conditions, the GE concentration increased further from 5.6 ppm to 8.5 ppm. Therefore test 9 shows that high pressure deodorization only is not sufficient to mitigate GE, but that the presence of FFA during the deodorization is necessary to achieve the mitigation. This observation is confirmed by test 10.

Indeed, in test 10, the same conventionally refined oil, obtained in test 7 and containing 5.6 ppm of GE, is supplemented with 3% of FFA (pure stearic acid) and deodorized again at high pressure in the same conditions that the one used in test 8 and 9. Deodorization in those conditions induces a reduction of the GE concentration from 5.6 ppm down to 1.6 ppm. This clearly shows that FFA destroy GE during the deodorization and that high deodorization pressure is necessary to maintain a substantial FFA concentration during said deodorization.

Therefore, it has been surprisingly observed that the presence of FFA in the oil can even destroy GE if the incoming oil already contains GE. Without willing to be bound to any theory, it is believed that the acidic strength of FFA becomes stronger at high temperature and as such may react with and decompose GE similarly to what is observed when a high GE oil is bleached with an acid activated bleaching earth. It is possible that the final GE concentration obtained after a deodorization realised in presence of FFA is ruled by a chemical equilibrium. However, the exact nature of this chemical equilibrium is currently unknown.

Thus, practically, the best technical option to maintain a substantial concentration of FFA during the deodorization step is to perform this one at high pressure in order to minimize the vaporisation of those FFA. Such deodorization at high pressure is very unconventional and not applied in vegetable oil refining. Indeed, currently, deodorization at low pressure is preferred and the trend is to conduct physical refining at even lower pressures which are perceived as able to remove any contaminant more efficiently. Our invention has surprisingly shown that deodorization at high pressure in presence of substantial amount of FFA can be advantageous and is, in particular, advantageous for the mitigation of GE. Based on FIG. 2, a FFA residual concentration of 0.5% after the deodorization already induce a noticeable GE mitigation. Higher concentration of FFA induce an even more noticeable GE mitigation. However, such higher FFA concentration can only be attained with high pressure deodorisation.

Therefore, the present invention is particularly economical compared to technologies of the prior art. The present invention does not make use of adsorbents or chemicals. FFA are one of the natural components of crude vegetable oils. Indeed, FFA are natively present in crude vegetable oils, in various concentrations, and thus are no chemicals stricto sensus and will not induce unexpected adverse effects as could be the case when contacting an oil at high temperature with chemicals such as citric acid or oxalic acid which are of course not natively present in any vegetable oil and are substantially stronger acids than free fatty acids.

Furthermore, the present invention further reduces the waste stream. Indeed, since much less GE are formed during the deodorization step, the stripping steam exiting the steam-stripping step following the deodorization step, and that is condensed, will contain less GE. Furthermore, the volume of the effluent could be reduced as well. Indeed, since the quantity of GE is already considerably reduced during the deodorization step, compared to current practice, the volume of stripping steam needed in the stripping step to reach a given GE limit may be reduced compared to a steam-stripping of a deodorised oil containing more GE.

Thus, the present invention does not contact the processed oil with chemicals such as citric acid or oxalic acid, immobilised solid acids or bleaching earths or pieces of equipment requiring additional investment and that may, for some of those technical solutions, generate an off taste requiring a new deodorization or that could have unidentified adverse effects. Furthermore, the present invention may reduce effluents compared to current practices.

Another advantage of the present invention is that the deodorization step can be realized at high temperature and therefore the heat bleaching and the deodorization effects (removal of colours, odours and taste) remains optimal and are not compromised by a deodorization step made at lower temperature (230° C. or lower). However, despite such high deodorization temperature, the net GE formation is reduced as compared to deodorization realized in standard conditions. For oils already containing a significant concentration of GE, the process according to the present invention is even able to reduce the concentration of GE. Those observations were never realized before and are totally unexpected.

The process according to the present invention can be implemented easily in existing and in new refining facilities and furthermore leads itself to various configurations. The process according to the present invention can even be implemented in equipment that are not assimilated to classical physical refining facilities as known and currently used in the industry. Indeed, the fact that the deodorization step, can be realised at high pressure, for example pressure ranging preferably from about 5 mbara to about 100 mbara), and preferably with small amount of sparging steam, permits to implement said deodorization step in pieces of equipment that are much simpler and economical than a standard deodorizer built to maintain a very low pressure combined to substantial supply of sparging steam and usually designed with many deodorising trays. For example, according to the present invention, the deodorization step, and more particularly the heat bleaching could be done just after the absorptive bleaching (i.e., the absorptive bleaching realised with bleaching earths) in a simple vessel connected to the same vacuum group than the one used during the absorptive bleaching. Indeed, the absorptive bleaching of the oil is usually realised at a vacuum of 50 to 100 mbara by contacting said oil with bleaching earths at a temperature of about 90° C. After the absorptive bleaching, the oil simply needs to be heated in a heat exchanger to a temperature of for example 260° C. and maintained for an adequate time of for example about 60 minutes at a vacuum of 50 to 100 mbara and agitated with a small quantity of sparging steam. The oil can then be transferred directly to a steam-stripper or optionally, firstly, to a deodorizer where the deodorization can be completed, if needed, preferably in any conditions giving GE mitigation.

The main parameters of the process according to the present invention will now be described in more details. Some advantages of the inventions will also be listed.

Deaeration of the Oil.

It is important to properly deaerate the oil intended to be physically refined according to the process of the present invention. Indeed, in the present process, it is primordial to realize the deodorization step at high temperature and at higher pressures. In those conditions, the presence of any remaining air in the processed oils may lead to its oxidation, something that must be avoided absolutely. Proper deaeration is realized by maintaining the oil at moderate temperature under vacuum. Optionally inert gases like nitrogen can be sparged during the deaeration to further displace any oxygen than may still be dissolved in the oil. The deaeration procedure is important prior to any physical refining and known by the skilled artisan. In the process according to the present invention the deaeration of the oil is at least equally important as it is prior to any conventional physical refining.

FFA Concentration During the Deodorization Step.

In the process according to our invention, the FFA concentration in oil during the deodorization step is preferably ranging from 0.5 to 10%, and even more preferably ranging from 2 to 5%. In most instances, an acceptable concentration of FFA corresponds to the inherent quantity of FFA naturally present in the oil to be physically refined for the first time. As a matter of fact, usually, the more an oil contains partial glycerides, known as precursors of GE, the higher will be its FFA concentration. This trend is of course not observed for oils that have been already refined. For degummed and bleached palm oil, this concentration will in most instance ranges approximately from about 1% to about 5% depending on the quality and freshness of the oil but can even exceed 5% for older and/or palm oil of inferior quality. However, adding FFA to the oil or fat prior to its physical refining is an optional embodiment of the present invention but this option is usually reserved to oil or fat that have already been physically and/or chemically refined and have thus a very low content of FFA. In that case, adding about 0.5 to 10%, preferably about 2 to 5% of FFA or optionally FAD is necessary to either avoid the net increase of GE during the deodorization step or even destroy, at least partially, GE already present. On the contrary, adding supplementary FFA to an oil or fat that has only been degummed and bleached, at that thus contains naturally substantial amount of FFA, is usually not necessary. It must be understood that the conditions of the deodorization step must be adapted to avoid the removal of the FFA during the deodorization step or at least during a major part of it. Thus, the FFA concentrations mentioned above do not corresponds the residual FFA concentration after the completion of the deodorization step. The residual FFA concentration after the deodorization step is usually reduced by about 10 to 75% (corresponding to about 1% to about 4.5% of residual FFA if the starting oil contains about 5% of FFA). However, compared to standard deodorization practices, this FFA residual concentration is considerably higher. Indeed, typically the FFA concentration after a standard deodorization realised at low pressure usually does not exceed 0.1% because most of those FFA are stripped and/or volatilised from the oil.

Pressure During the Deodorization Step

Pressure during the deodorization step is preferably selected to avoid excessive stripping and/or volatilisation and removal of FFA from the processed oil. Pressure during the deodorization step is preferably ranging from about 5 mbara to about 100 mbara, even more preferably from about 10 mbara to about 50 mbara. It is believed that very high pressure above about 100 mbara are not advantageous for the process according to the present invention. Indeed, at such high pressure, and for a temperature of about 260° C., no volatilisation of the FFA will occur and therefore the maximal amount of FFA present in the deodorised oil is reached. Furthermore, the oil may start to oxidize slightly at pressure higher than 100 mbara. Assuredly, such high pressures are not applied in the field of the oils and fats deodorization. Indeed, the trend in the industry is definitively in favour of deep vacuum such as pressures lower than 5 mbara, preferably lower than 3 mbara. Surprisingly, it has been observed that higher pressures during the deodorization step, typically above about 5 mbara, preferably above about 10 mbara are much more favourable for the mitigation of GE during said deodorization step than deep vacuum that is currently preferred in the industry. This current preference seen in the industry is based on the assumption that deep vacuum will remove more efficiently any contaminant from the processed oil than partial vacuum (higher pressure). Deep vacuum is also preferred because usually, less sparging steam is required. However, this advantage is balanced by the large volume of motive steam and the equipment (boosters, pumps) needed to create such deep vacuum. Therefore, the process according to our invention, relaying on high pressure during the deodorization step is not only counter-intuitive but also more economical since less energy and less equipment are needed to create the high pressure (partial vacuum) compared to current deodorization process relaying on deep vacuum. Since the present process preferably makes use of limited amount of sparging steam during the deodorization step, in order to limit the stripping and/or volatilisation of the FFA, the advantage given by deep vacuum to reduce the needed sparging steam becomes moot.

Sparging Steam Ratio During the Deodorization Step

It is preferred to reduce the amount of sparging steam during the deodorization step in order to minimize the FFA stripping and/or volatilisation and removal. Therefore, a minimal amount of sparging steam is used, typically preferably less than about 5 kg of steam per ton of processed oil, even more preferably less than about 2 kg of steam per ton of processed oil. However, it is not advisable to suppress totally the sparging steam during the deodorization step as this may lead to insufficient oil mixing, oil degradations and/or the fouling of the metallic surface of the deodorizer, in particular the deodorizing tray(s). Thus, the sparging steam that is injected in the deodorization step is intended to get a good mixing of the oil and not to get good stripping of volatile components (incl. FFA). Therefore, the use of high pressure during the deodorization step is not penalized by the requirement of using large amount of sparging steam. On the contrary, the process according to the present invention requires overall less sparging steam and less motive steam compared to current deodorization processes. Again, this advantage is substantial and totally unexpected and was never observed before.

Oil Temperature During the Deodorization Step

It is preferred to realize the deodorization step at the temperature that will optimize the full heat bleaching and deodorization of the processed oils. For most oils, this temperature is usually comprised between about 200° C. and about 280° C., preferably comprised between about 240 and about 275° C., more preferably comprised between about 250° C. and about 270° C., even more preferably comprised between about 255° C. and about 265° C., which was the typical standard deodorization temperature range for palm oil prior to the GE issue had triggered milder deodorization conditions. The exact oil temperature during the deodorization step of the process according the present invention can therefore by adapted to the feedstock and to the target properties of the final physically refined oil. However, temperatures above than about 280° C. are not preferred because the oil may start to thermally degrade at such high temperatures. Temperatures lower than 230° C. may be beneficial, for particular oil, to further enhance some health properties of the final oil, especially for oil that are rich in essential minor components and sensible to thermal degradation. As a matter of fact, the general rules and practices concerning the deodorization oil temperature that were used in the refining industry before the arising of the GE issue, can usually be selected when oils are physically refined according to the present invention.

Thus, according to the present invention, deodorization at low temperatures is not mandatory to limit the occurrence of GE. The advantage of the present invention is that surprisingly, the deodorization and heat bleaching step of the physical refining can be realised at high temperature simultaneously with a substantial mitigation of GE. It also means that the duration of the deodorization step can be limited. Indeed, so far, the general trend in the edible oil refining industry, in an attempt to minimize the occurrence of GE, was to realize the deodorization step at low temperature during an extended period of time. Unfortunately, this attempt, usually successful for the mitigation of GE, is done at the cost of incomplete heat bleaching and deodorization despite longer processing time.

Duration of the Deodorization Step

As a general rule, the duration of the deodorization step should be set to obtain the targeted properties of the final product, such as the organoleptic and colour properties and this duration will depend on many factors including the quality of the incoming oil and the target properties of the refined oil. Depending on the processed oil and on the final target properties of the physically refined oil, the deodorization duration can range from about 10 minutes to about 240 minutes. For example, in the case of palm oil, the duration of the deodorization preferably ranges from about 20 minutes to about 180 minutes, more preferably from about 30 minutes to about 120 minutes, even more preferably from about 45 minutes to about 90 minutes. As matter of fact, the duration of the deodorization is reduced and thus advantageous compared to deodorization realised at low temperature which requires much longer deodorization duration in an attempt to compensate its lower efficiency. Short deodorization duration is a supplementary potential advantage of the process according to the present invention since productivity is increased and deodorizer size and footprint may be reduced.

Concentration in GE after the Deodorization Step.

Low GE concentration has been observed when the deodorization step is carried on with the process according to the present invention and described hereabove. As shown in the examples, a GE concentration lower than 1 ppm can be obtained. For incoming oil containing already GE, like it is the case for conventionally physically refined oils, said GE can be even considerably reduced if the deodorization is realized according to the inventive process. This observation is particularly advantageous for oil that has been conventionally physically refined and that thus may contain a large quantity of GE. The process according to the present invention is therefore particularly advantageous to reprocess such oils that have been conventionally physically refined but that contains substantial GE concentrations. Such situation is mainly encountered in the case of palm oil deodorized a first time in a local refining facility situated in the direct vicinity of a palm plantation, and deodorized a second time, usually after a long transportation and storage period, just before its utilisation. The inventive process allows to deodorize and reduce the level of GE efficiently and economically by adding FFA to the oil that must be physically refined.

Steam-Stripping

In the physical refining process according to the present invention, a steam-stripping step following the deodorization step is mandatory because the deodorization step conditions are adjusted to control and limit the stripping and/or evaporation of FFA and thus the resulting FFA concentration, after said deodorization step, will generally largely exceed any trade specification. Furthermore, even if the GE is already considerably pre-mitigated during the deodorizing step, its concentration may still exceed the target limit. Therefore, the steam-stripping step is conducted after the deodorization step, preferably at low pressure, high temperature and with sufficient stripping steam to efficiently strip most of the remaining GE and FFA. Pressure at the top of the stripping column will be preferably below about 5 mbara, even preferably below about 3 mbara and even more preferably below about 2 mbara. The steam-stripping step is usually conducted at a temperature ranging from about 220° C. to about 280° C., preferably from about 230° C. to about 260° C. A metallic packed column is preferably used during the steam-stripping step. Amount of the required stripping steam will be highly dependent on the temperature, the pressure, the concentration of the GE present in the deodorized oil, the specifications of the equipment used to perform the steam-stripping step, and the targeted GE concentration in the final physically refined oil. Typically, at least 0.5% of stripping steam is necessary to remove about 80% of the GE present in the deodorized oil if the post-stripping is realized at 260° C. at 1.5 mbara in a metallic packed column. Milder stripping conditions will lead to a lower GE removal rate that may, for some applications, still be sufficient to produce a physically refined oil meeting the targeted specifications because the GE was already pre-mitigated in the deodorization step. It must be understood that all the previous parameters are inter-dependent and that the nature and design of the equipment used to perform the steam-stripping step may strongly influence the performances of the post-stripping step.

A supplementary advantage of the process according to the present invention is that the steam-stripping is able to deliver an oil containing very low concentration of GE since the oil that is entering said steam-stripping step contains already a moderate concentration of GE. It has been shown that, with industrial equipment, the steam-stripping step is usually able to remove about 80% to about 90% of the GE. Thus, if an oil is physically refined according to the disclosed invention and contains for example 2 ppm of GE after the deodorization step, this concentration will be further reduced by 80% during the steam-stripping step to a least 0.4 ppm. On the opposite, if the same oil is deodorized in conventional conditions i.e., at low pressure and high temperature, this one will typically contain about 5 to 6 ppm of GE and even if a subsequent steam-stripping step remove 80% of this amount, the final oil will still contain slightly more than 1 ppm of GE which is exceeding the most recent legal limits.

Another advantage of the process according to the present invention is that the pre-mitigation of GE during the deodorization step makes possible to use milder conditions during the subsequent steam-stripping step, in particular it allows to reduce the amount of stripping steam to be used to obtain an oil having low GE content. Therefore, the process according to our invention is more cost-efficient and will generate reduced waste stream compared to conventional processes. Indeed, typically, the steam exiting the stripping step is condensed and will lead to a contaminated water that must be treated. Thus, reducing the amount of stripping steam, and limiting the contamination level in the corresponding used stripping steam lead directly to the reduction of this aqueous waste stream.

Yet another advantage of the present invention is that milder conditions during the steam-stripping step will limit the removal of valuable volatile components such as partial glycerides and antioxidants (tocopherols for example). Therefore, the process according to our invention may have a superior yield compared to prior art processes and may produce an oil of better stability containing more natural antioxidants.

Cooling of the Oil after the Steam-Stripping Step

Rapid cooling of the oil after the steam-stripping step is essential. Preferably the oil temperature must be reduced below 230° C. in less than a few minutes, preferably in less than 5 minutes. Preferably the cooling is realized under high vacuum and in presence of sufficient amount of sparging steam. This is necessary to avoid the formation GE again while cooling down since at that stage of the process the oil contains only a limited concentration FFA. Once the oil is below 230° C., the oil can be cooled in conventional economizers. Such rapid cooling can be realised by several technical solutions that are known in the art including high-surface heat-exchangers or falling film oil-oil recovery systems for example. Rapid cooling can also be accomplished by dropping the steam-stripped oil directly in a cold bath of oil where part of the fully cooled physically refined oil is used as a direct cooling medium.

Treatment and Recycling of the Condensed Fatty Acid Distillate Phase

The fatty acid distillate (FAD) resulting from the condensation of the stripping steam exiting the stripper contains large amounts of FFA, GE, monoacylglycerol and some diacylglycerol, tocopherol and various contaminants including mono-esters of 3-MCPDE and pesticides. However, a fraction of said FAD can be recycled by mixing it in the incoming oil that will be processed according to the present invention. Such recycling is particularly advantageous for oils that have already been deodorized by conventional processes and that thus does not contain FFA but may contain excessive amounts of GE. The FAD corresponding to those oils that have been already deodorized once by conventional process usually contains limited amount of contamination at the exception of GE. However, it has been shown that part of the GE is not stripped but degraded during the deodorization realised according to the process of the present invention.

Furthermore, the FAD resulting from the condensation of the vapor phase exiting the stripper is advantageously heated at about 260° C., at high pressure or at adiabatic pressure. This treatment results in a reduction of GE contained in said FAD. Therefore, the FAD is substantially less contaminated by GE and its use or disposal is therefore less problematic. This treated FAD can even be incorporated in some oils intended to be physically refined according to the process of the present invention, in particular if those oils containing low amounts of FFA such as oil that have been already physically refined.

Post-Deodorization

The oil exiting the steam-stripper usually does not need to be post-deodorized. When a post-deodorization is needed, this one is usually realised in mild conditions (i.e., low temperature) because the oil resulting from the process according to the present invention has been already intensively deodorized once, and hence generally possess, the adequate organoleptic qualities, colour, and stability. Besides, post-deodorization at high temperature will again lead to the formation of GE. However, for some grade of palm oil, in particular oil of substandard quality, a post-deodorization may be necessary. In that case, care should be taken to realise the post-deodorization at low temperature in order to reduce the formation of GE as much as possible. Therefore, the oil is preferably deodorized at low temperature such as 220° C. for example. The post-deodorization is also realised with sufficient sparging steam input, preferably 0.5-1% or more and at very low pressure in order to steam-strip and/or evaporate any new GE that still may be formed. Since this post-deodorization is usually realised within a limited time, the usage of high amount of sparging steam in not cost prohibitive. Furthermore, the steam used for such post-deodorization is still substantially clean and is not lost as it can be used as sparging and/or stripping steam again. Hence, in case of needed post-deodorization, the steam is preferably used counter-currently twice: firstly, for post-deodorizing the oil, and secondly for the deodorization step at high pressure and high temperature and/or for the steam-stripping step. Therefore, the process according to the present invention remains economical even if a post-deodorization is needed. Alternatively, for some low-quality oil, a second physical refining according to the present invention may be preferred.

Industrial Implementation

Components of installations able to realize the physical refining according to the present invention are similar to components of installations used for the physical refining according to processes currently used in the field. Indeed, the physical refining according to the present invention makes use of a deodorizer vessel including at least one deodorizing tray and a stripper, preferably including a stripping column filled with a metallic structured packing (known as "metallic packed column" in the field). Those components are well known in the edible oil refining industry. Thus, no additional major components are necessary to execute the process according to our invention compared to classical physical refining facilities where the deodorization is realised after the steam-stripping. Furthermore, no chemicals or adsorbents are required. Furthermore, both the investment and running cost are similar to conventional physical refining installations which typically make use of a steam-stripper and a deodoriser but where the steam-stripping is realised before the deodorization.

Existing installations including most usually a steam-stripper and a deodorizer vessel and designed to carry on first the FFA stripping and secondly the oil deodorization and heat bleaching, can be retrofitted with proper piping and pumps in order to realise the process according the present invention wherein the deodorization is realized before the steam-stripping. Thus, usually, the retrofitting of existing installations can be realised with limited investment and down-time.

The deodorization step of the process according to the present invention can even be realised in pieces of equipment that are much simpler and more economical than a standard deodorizer built to maintain low pressure combined to substantial supply of sparging steam and usually designed with many deodorising trays.

The skilled artisan will be able to adapt existing installations to benefit from the present invention. The major divergences from current physical refining are the completion of the deodorization before the stripping and the realisation of the deodorization step at unconventional high pressure in presence of FFA. However, the implementation of those divergences is within the competence of the skilled artisan who will be able to select the pieces of equipment adapted to the disclosed invention.

Experimental Conditions

All the experiments (including test 1 to test 10, and the experiments leading to the Figures) were realized with degummed and bleached crude palm oil (CPO) batches of average quality containing from about 4% to about 5% of FFA. Prior to any test, the crude palm oil has been washed, acid degummed and bleached in standard conditions. Standard washing and acid degumming were conducted in glass batch reactors. Centrifugation of washed/degummed oil was done with a benchtop laboratory centrifuge. The degumming was realized by adding 0.1% of a 30% citric acid solution at 85° C. and high shear mixing the resulting mixture at atmospheric pressure, and by subsequently neutralizing, at least partially the unreacted citric acid by adding 0.03% of an aqueous solution of NaOH and high shear mixing the resulting mixture at atmospheric pressure and finally adding 3% of deionized water at 85° C. and agitating the mixture at low shear for 10 min. The resulting mixture was then separated by centrifugation. The resulting oil was then bleached with 2% natural bleaching earth Pure Flo B80, at 105° C. and 50 mbar for 30 minutes, followed by Buchner vacuum filtration over Whatman 1 filter paper; all percentage are w/w percent. Depending on the batch, this washed, degummed and bleached oil contains naturally about 5% of FFA and no detectable GE. Naturally means that no FFA was added in the oil but that those FFA arise from the usual hydrolysis of the oil during its extraction, transportation, storage, and possibly from the washing, degumming and bleaching operations. Thus, according to the batch of crude oil used, the FFA concentration may vary slightly but the exact concentration is always provided for each experiment.

Deodorization tests have been realised in a lab deodoriser permitting the withdrawal of oil sample for various deodorization time at various temperature, pressure and time. Given the size of the deodorizer the temperature and pressure are precisely controlled. Any collected oil sample is rapidly cooled.

Steam-stripping tests have been realized either in a lab shallow tray stripper or in a lab metallic packed column stripper. However, since the lab metallic packed column stripper require a relatively large quantity of oil, this equipment has been used to confirm the results obtained with lab shallow tray stripper.

Particular deodorization and/or post-stripping conditions were detailed in the discussion of each experiments.

Any collected oil sample is rapidly cooled prior to the analytical evaluation including the follow methods: AOCS Ca5a-40 (FFA determination); AOCS Cd29b-13 (GE determination); AOCS Cd29b-13 (3-MCPDE determination); AOCS Cd29b-13 (2-MCPDE determination); AOCS Cc13J-97 (Colour determination).

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention. Combinations of the above embodiments and other embodiments will be apparent to those of skill in the art upon studying the above description and are intended to be embraced therein. Therefore, the scope of the present invention is defined by the appended claims, and all devices, processes, and methods that come within the meaning of the claims, either literally or by equivalence, are intended to be embraced therein.

The invention claimed is:

1. A process for the physical refining of vegetable oil including:

a) a deodorization step carried out at a pressure above 5 mbara, at a temperature of at least 230° C. and during at least 10 minutes, b) a steam-stripping step of the oil resulting from the deodorization carried out at a pressure below 5 mbara, and at a temperature not exceeding 280° C., wherein the free fatty acids (FFA) concentration of the oil resulting from the deodorization step contains at least 0.5% of FFA, and further contains no more than 5 ppm of glycidyl esters (GE).

2. The process according to claim 1 wherein said deodorization step is carried out at a pressure:

above 10 mbara;

above 20 mbara; or above 50 mbara.

3. The process according to claim 1 wherein said deodorization step is carried out at a temperature of:

at least 245° C.; or at least 260° C.

4. The process according to claim 1 wherein said steam-stripping step is carried out at a pressure:

below 3 mbara; or below 2 mbara.

5. The process according to claim 1 wherein said oil resulting from the deodorization step contains:

at least 1% of FFA; or at least 2% of FFA.

6. The process according to claim 1 wherein said oil resulting from the deodorization step contains:

no more than 3 ppm of GE;

no more than 2 ppm of GE;

no more than 1 ppm of GE; or no more than 0.5 ppm of GE.

7. The process according to claim 1 wherein the oil arising from said stripping step is:

cooled at a temperature not exceeding 230° C. in less than 5 minutes;

cooled at a temperature not exceeding 230° C. in less than 5 minutes and further deodorized in a second deodorization step by contacting said cooled oil with steam at a temperature not exceeding 230° C. and at pressure below 5 mbara for a duration of at least 10 minutes; or cooled at temperature not exceeding 230° C. in less than 5 minute and further deodorized in a second deodorization step by contacting said cooled oil with steam at a temperature not exceeding 230° C. and at pressure below 5 mbara for a duration of at least 10 minutes and the steam exiting the second deodorization step is at least partially recycled in the deodorization step a) and/or the steam-stripping step b).

8. The process according to claim 1 wherein the vegetable oil intended to be physically refined is:

washed and/or degummed and/or chemically bleached;

bleached by contacting it with bleaching earth and said contacting is realised at a low pressure; or bleached by contacting it with bleaching earth and said contacting is realised at a low pressure and the deodorization step a) is realised essentially at the same low pressure.

9. The process according to claim 1 wherein FFA is added to the vegetable oil about to be deodorized.

10. The process according to claim 1 wherein said stripping step is carried out by contacting the oil with the stripping steam:

in a metallic packed column;

in a falling film; or in a shallow tray deodorizer.

11. The process according to claim 1 wherein the steam exiting the steam-stripping step b) and containing fatty matters stripped from the oil:

is cooled and at least a part of said fatty matter is condensed to yield a liquid fatty phase that is at least partially added in the vegetable oil intended to be deodorized;

is cooled and at least part of said fatty matter is condensed to yield a liquid fatty phase, said liquid fatty phase being heated at a temperature of at least 200° C.; or is cooled and at least part of said fatty matter is condensed to yield a liquid fatty phase, said liquid fatty phase being heated at a temperature of at least 200° C., and at least partially added in the vegetable oil intended to be deodorized.

12. The process according to claim 1 wherein said vegetable oil is a tropical oil, wherein said tropical oil is palm oil, palm kernel oil, coconut oil, or karite oil.

13. The process according to claim 1 wherein said vegetable oil has already been physically refined or modified by processes, wherein said processes are solvent and/or dry fractionation, interesterification or hydrogenation.

14. The process according to claim 1 wherein said vegetable oil contains 1 to 10% FFA.

15. The process according to claim 1 wherein said vegetable oil is supplemented with FFA.

* * * * *